US006473041B2

(12) United States Patent
Koch et al.

(10) Patent No.: US 6,473,041 B2
(45) Date of Patent: Oct. 29, 2002

(54) MUNITION ARTICLE WITH ANTENNA FOR SATELLITE NAVIGATION

(75) Inventors: Volker Koch, Rückersdorf; Martin Hertel, Lauf; Werner Wiesbeck, Keltern; Eberhard Gschwendtner, Karlsrube, all of (DE)

(73) Assignee: Diehl Munitionssysteme GmbH & Co. KG., Röthenbach (DE)

( * ) Notice: Subject to any disclaimer, the term of this patent is extended or adjusted under 35 U.S.C. 154(b) by 0 days.

(21) Appl. No.: 09/919,719

(22) Filed: Aug. 1, 2001

(65) Prior Publication Data

US 2002/0014998 A1 Feb. 7, 2002

(30) Foreign Application Priority Data

Aug. 3, 2000 (DE) ..... 100 37 886

(51) Int. Cl.[7] ..... F42C 13/04

(52) U.S. Cl. ..... 343/700 MS; 102/214; 89/1.11

(58) Field of Search ..... 343/700 MS, 769, 343/767, 705, 768; 102/214, 211, 293; 244/3.14, 3.21

(56) References Cited

U.S. PATENT DOCUMENTS 3,810,183 A * 5/1974 Krutsinger et al. ..... 343/708

6,098,547 A * 8/2000 West ..... 102/214

* cited by examiner

*Primary Examiner*—Don Wong
*Assistant Examiner*—James Clinger
(74) *Attorney, Agent, or Firm*—Scully, Scott Murphy & Presser

(57) ABSTRACT

A munition article (11) is to be provided with an antenna (18) which, by virtue of a characteristic which is uniform all around, permits interference-free reception of items of satellite navigation information, even if in the manner of an artillery projectile (12) it is fired with spin along an elongate ballistic trajectory, so that a tail antenna with a spherical characteristic does not allow the expectation of good reception factors in relation to navigation satellites which are as high as possible above the horizon. Therefore the fuse tip (13) of the projectile (12) is equipped with a hollow-frustoconical portion of electrically conductive material such as light metal, which is designed in the form of a round-slot satellite antenna (18) and in which a coaxial annular hollow space (25) opens to the peripheral surface (19) of the fuse through a slot (23) which extends around the arrangement radially with respect to the longitudinal axis (16) of the projectile and which is in the form of an annular disc configuration. As feed cables coaxial cables (28), distributed uniformly around the periphery, can be connected with their inner and outer conductors (28.1, 28.2) at the inner mouth opening (22.2) of the slot (20) towards the hollow space (25) to the slot walls (31).

8 Claims, 1 Drawing Sheet

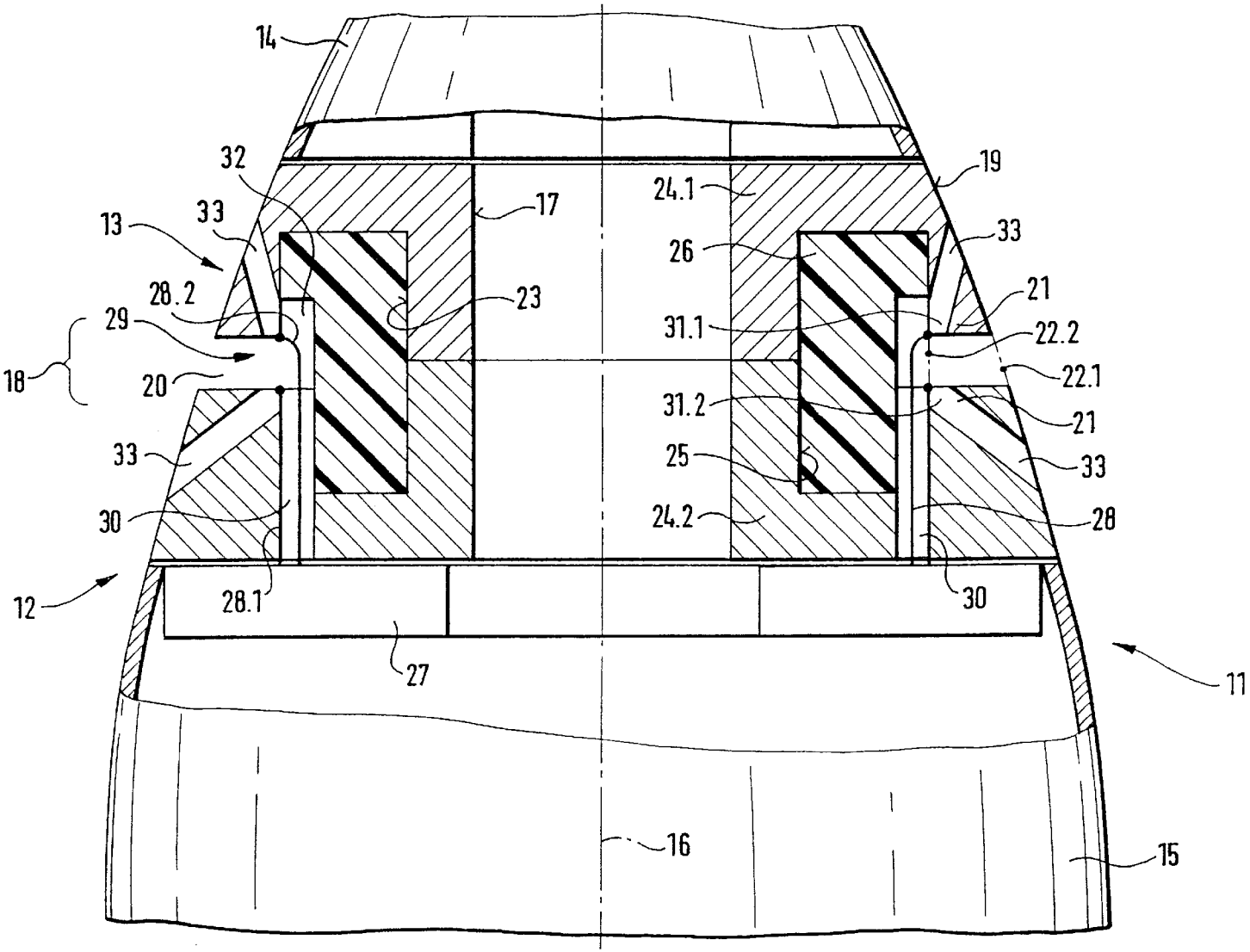
11
15
19
33
21
22.2
22.1
21
33
28
30
24.1
26
31.1
31.2
25
24.2
16
17
23
27
14
32
33
28.2
13
29
20
33
30
28.1
18
12

MUNITION ARTICLE WITH ANTENNA FOR SATELLITE NAVIGATION

BACKGROUND OF THE INVENTION

1. Field of the Invention

The present invention relates to an article of ammunition which includes an antenna for satellite navigation.

2. Discussion of the Prior Art

A munition article of that kind is known from WO 99/02936 A2 in the form of a droppable bomb with sandwich-like or patch-like satellite antenna arranged in the centre of its tail. During the dropping movement into the target area the spherical antenna characteristic thereof maintains contact with navigation satellites which are above the horizon, in order to increase the bomb hit accuracy by means of final phase control, more specifically by comparison between the target point which is predetermined in terms of co-ordinates and the geodetic actual position of the munition article.

Such an antenna configuration is however unsuitable for munition articles in the form for example of artillery shells. For, during the major part of the extended ballistic flight, the antenna directional characteristic which is oriented rearwardly from the tail antenna substantially symmetrically with respect to the longitudinal axis of the projectile would be directed approximately to the horizon, and initially even therebelow, and only slightly thereabove after the apogee. As a result there is a rather low level of probability of being able to receive a plurality of navigation satellites simultaneously with a sufficient level of freedom from interference for rapid and precise trajectory point determination, for the purposes of trajectory correction. Even the incorporation of such a patch antenna into the tip of the projectile would be unsatisfactory because its spherical characteristic which would then be oriented coaxially forwardly would be directed markedly above the horizon only in the very first phase of the ballistic trajectory, in order to be able to detect a plurality of satellites in an appropriate configuration; while the tip, after passing through the apogee, is even directed towards the ground and with such an antenna it would then be possible at best to pick up the very interference-afflicted ground reflections of the signals from navigation satellites, the processing of which sufficiently quickly results in usable items of 1navigation information, if at all, only by way of considerable signal processing complication and involvement.

Furthermore, in the case of a munition article in the form of an item of artillery munition, in view of the antenna characteristic which is not ideally spherical in practice, the problem of stabilisation rotation arises. For, with an antenna characteristic which is not circular in cross-section, the consequence of the spin which occurs upon launch from a rifled barrel is that the received satellite signals are modulated in dependence on rotation, and that severely adversely affects evaluation of the signals from a plurality of satellites in immediate succession, which signals are to be compared together in rigid phase relationship in themselves for positional determination purposes.

SUMMARY OF THE INVENTION

In consideration of those factors the object of the present invention is therefore that of providing a munition article which is fired in the manner of an artillery projectile along a substantially horizontally extended trajectory with an antenna which has an appropriate directional characteristic for the reception of items of satellite navigation information.

In accordance therewith a round-slot antenna opens into the peripheral surface of a hollow-frustoconical portion of the projectile fuse tip. The slot thereof extends transversely with respect to the axis of the cone configuration and the projectile, in the form of a radial annular disc, through the wall of the hollow-frustoconical portion. In order to promote in front of the peripherally extending slot and thus in the space around the hollow-frustoconical portion, a toroidal or torus-like electromagnetic radial reception characteristic which is possibly set somewhat forwardly, arranged at a radial spacing relative to the inner slot opening, oriented transversely with respect to the slot and thus coaxially with the longitudinal axis, are a cylindrical metal reflector wall and between same and the inner slot opening a hollow space or cavity which is closed metallically, that is to say by means of a cover plate and a bottom plate, in both axial directions. For connecting that antenna to a receiving circuit, there are feed lines at positions which are equidistantly displaced relative to each other along the peripherally extending slot, which are connected in a two-pole mode, preferably being coaxial cables, with their outer and inner conductors respectively, to the two mutually axially oppositely disposed edges of the inner slot opening which opens into the hollow space or cavity. For that purpose the feed cable at that respective coupling-out location is passed in substantially parallel relationship with the axis through the bottom plate of the hollow space or cavity along the inside peripheral surface of the outer wall of the hollow-frustoconical portion and into same.

The hollow space or cavity is divided transversely with respect to the longitudinal axis in order to be able to insert a ring comprising a material which is as poor an electrical conductor as possible, of increased dielectric constant, which independently of frequency and temperature as much as possible is also distinguished by low dielectric losses and a high level of creep or tracking resistance, such as fluorine-bearing polymer PTFE (polytetrafluoroethylene), which is on the market under trade names such as Teflon, Fluon or Hostaflon. Such an insert ring makes it possible to provide for adaptation of the electrical tuning of the hollow space or cavity to the satellite frequencies.

BRIEF DESCRIPTION OF THE DRAWINGS

Additional developments and further features and advantages of the invention will be apparent from the further claims and from the description hereinafter of a preferred embodiment of the structure according to the invention which is shown diagrammatically and not entirely true to scale and in greatly abstracted form, being restricted to what is essential. This structure affords the advantage that it can be implemented in the fuse tip which is usually removable from an artillery projectile, and therefore can also be subsequently applied to a standard projectile, without having to intervene in the load-bearing structure of the projectile case itself for providing the peripherally extending antenna slot.

The single FIGURE of the drawing is a broken-away axial longitudinal section of a round-slot satellite antenna which is fitted into the fuse tip of a projectile.

The munition article 11 which is diagrammatically shown in the broken-away axial longitudinal section is an artillery projectile 12 with a replaceable fuse tip 13 under a ballistic cap 14 in front of the hollow-cylindrical projectile case of the body 15. The fuse tip 13 has a central passage 17 extending therethrough in coaxial relationship with the longitudinal axis 16 of the projectile, for the mechanical assembly devices (not shown) and for coupling an impact sensor disposed at the front end in the tip 13 to a firing transfer device which is arranged in the transitional region between the tip 13 and the body 15 and which has a safety device (not shown).

A hollow-frustoconical heightwise portion of the fuse tip 13 is in the form of a round-slot antenna 18 for receiving items of satellite navigation information for controlling the course of the projectile 12. At the nose and tail ends, the peripheral surface 19 thereof practically steplessly adjoins the conical peripheral surface of the rest of the fuse tip 13. The slot 20 of the antenna 18 is formed in the wall 21 of a hollow body of electrically conductive material, preferably light metal such as aluminium, and is disposed concentrically in a cross-sectional plane with respect to the longitudinal axis 16. The outer opening 22.1 of the slot 20 is disposed in the peripheral surface 19 of the wall 21. Reference 22.2 denotes the oppositely disposed inner opening of the slot 20. Disposed in opposite spaced relationship to the inner opening 22.2 of the slot 20 is a cylindrical reflector wall 23 which is coaxial with respect to the longitudinal axis 16. The wall 21 of the hollow-frustoconical portion and the reflector wall 23 are connected together at an axial spacing from the inner slot opening 22.2 by metal coaxial annular nose and tail cover plates 24.1, 24.2 in the respective cross-sectional plane with respect to the longitudinal axis 16, which plates thus at the same time represent the small and the large base surfaces respectively of the frustoconical round-slot antenna 18. Thus, defined between the radial cover plates 24.1, 24.2 at both sides, on the one hand, and the walls 21, 23 on the other hand, is a conductively enclosed, hollow-cylindrical hollow space or cavity 25 whose reflector wall 23 is at the same time the outside wall of the central passage 17 and which is opened outwardly through the slot 20.

The hollow space or cavity 25 is divided substantially in the central plane of the slot 20 in order to be able to insert a thick-walled hollow-cylindrical ring 26 of electrically non-conductive material with a dielectric constant which is markedly above that of air, for example of PTFE such as Teflon.

The round-slot antenna 18 is connected by way of at least one feed cable 28 which is illustrated here in the form of a coaxial cable to microwave circuits 27 for signal processing purposes, which in this embodiment as described in principle are installed in the tail region of the fuse tip 13 surrounding the passage 17 in an annular configuration. Preferably the assembly has a plurality of and at least three or four such coupling-out locations 29 for the connection of feed cables 28 distributed equidistantly around the periphery of the slot 23. At each thereof, an at least two-wire cable 28 is introduced into the annular hollow space or cavity 25 through a bore 30 in the tail cover plate 24.2 of the hollow space or cavity 25, parallel to the longitudinal axis 16, along the outer wall 21 thereof. The one conductor 28.1, possibly the outer conductor of the coaxial cable, is connected to the antenna 17 at the inner opening 22.2 of the slot 20, at the rear edge 31.2 thereof. The other conductor 28.2 of the cable 28, here then the inner conductor of the coaxial cable, also bridges over the inner slot opening 22.2 and is thereupon connected opposite to the first-mentioned conductor 28.1, that is to say to the front edge 31.1 thereof, as can be seen in the detail from the drawing. To provide those line guides, openings 32 are formed in parallel relationship with the axis in the rearward region of the outer peripheral surface of the ring 26 which is fitted into the hollow space or cavity 25.

To provide for electrical and mechanical connection, which is of small area in as highly defined a fashion as possible, of the outer and inner conductors 28.1, 28.2 to the inner slot opening 22.2, the arrangement includes access passages 33 provided in the wall 21 of the hollow-frustoconical round-slot antenna 17, being inclined with respect to the longitudinal axis 16 or the plane 20 of the slot, from the peripheral surface 19. Depending on the respective kind of fixing involved (for example clamping terminals or soldering), it is possible to introduce tools through those passages 31, for example a clamping tool, a soldering iron or directly radiant or conductive heat can be applied in a very specific and targeted fashion to coupling locations 29 to be soldered and there to the ends of the conductors 28.1, 28.2. In accordance with the present invention however it can also be provided that for example clamping fixings are prepared at the coupling locations 29, such fixings becoming operative when the conductors are fed thereto.

Such access passages 33 which after the assembly procedure can be closed with pasty electrically conductive material extend at an angle which is as large as possible with respect to the transverse plane of the peripherally extending slot 20 in order to allow as much undisturbed metal material as possible to remain at the outer opening 22.1 of the slot into the peripheral surface 19, for the electrical slot action, that is to say, in the interests of affording a toroidal response characteristic on the part of the round-slit antenna 17, which characteristic is as far as possible undisturbedly concentric and which is oriented radially somewhat forwardly.

Thus, in accordance with the invention, a munition article 11 is equipped with an antenna 18 which, by virtue of an annular torus characteristic which is uniform all around and which is oriented radially somewhat forwardly, permits interference-free reception of items of satellite navigation information, even if in the manner of an artillery projectile 12 it is fired with spin along an elongate ballistic trajectory, out of which a tail antenna with a spherical characteristic does not allow the expectation of good reception factors in relation to navigation satellites which are as high as possible above the horizon. On the contrary the fuse tip 13 of the projectile 12 is now equipped with a hollow-frustoconical portion of electrically conductive material such as light metal, which is designed in the form of a round-slot satellite antenna 18 and in which a coaxial annular hollow space 25 opens to the peripheral surface 19 of the fuse through a slot 23 which extends around the arrangement radially with respect to the longitudinal axis 16 of the projectile and which is in the form of an annular disc configuration. Feed cables 28, distributed uniformly around the periphery, are connected with their signal and ground conductors 28.2, 28.1 at the inner mouth opening 22.2 of the slot 20 towards the hollow space 25, to the slot walls 31.

What is claimed is:

1. A projectile (12) including a satellite antenna (18) with a toroidal electromagnetic field receiving pattern concentric of a longitudinal center axis (16) of a fuse tip (13) of said projectile (12); wherein said antenna comprises an electrically conductive wall (21) of a hollow frusto-conical vertical cutout in said fuse tip (13), said wall (21 ) being traversed by an annular ring-shaped slot (20) oriented in a radial cross-sectional plane relative to the longitudinal center axis (16), said slot (20) opening at a first side along an outer periphery (22.1) thereof in an outer peripheral surface (19) of said fuse tip (13), said fuse tip (13) opposite a central cylindrical reflector wall (23) which is radially distant from and coaxial to said longitudinal axis (16), at a second side, communicating at an inner periphery thereof with a metallically conductive cylindrical hollow space (25) concentrically encompassing said longitudinally center axis (16); and a hollow cylindrical ring (26) of an electrically non-conductive material possessing a dielectric constant which is greater than air being arranged in said hollow space (25).

2. A projectile as claimed in claim 1, wherein an inner opening (22.2) of said annular ring-shaped slot (20) facing said hollow space (25) includes a plurality of peripherally uniformly spaced coupling locations (29) for the connection of electrical feed cables (28).

3. A projectile as claimed in claim 2, wherein there are provided at least three of said coupling locations (29) for feed cables (28).

4. A projectile as claimed in claim 2, wherein at said coupling locations (29) there are provided conductors (28.1; 28.2) of respective feed cables (28) which are connected to an outer wall of said hollow space (25), said feed cables (28) being introduced into said hollow space (25) in parallel with said longitudinal center axis (16) at a tail end of said projectile fuse tip.

5. A projectile as claimed in claim 2, wherein terminal clamps for said feed cables (28) are arranged at said coupling locations (29).

6. A projectile as claimed in claim 2, wherein said fuse tip (13) includes passages (33) providing for access to said coupling locations (29), said passages extending from said slot (20) to said outer peripheral surface (19).

7. A projectile as claimed in claim 6, wherein said passages (33) extend in an inclined orientation from an inner edge opening (22.2) of slot (20) to said outer peripheral surface (19).

8. A projectile as claimed in claim 6, wherein said passages (33) are sealed with an electrically conductive paste material subsequent to connection of said electrical feed cables (28) with said coupling locations (29).

* * * * *